US006027050A

United States Patent [19]

Rembold et al.

[11] Patent Number: 6,027,050

[45] Date of Patent: Feb. 22, 2000

[54] INJECTION VALVE IN PARTICULAR FOR DIRECTLY INJECTING FUEL INTO THE COMBUSTION CHAMBER OF AN INTERNAL COMBUSTION ENGINE

[75] Inventors: Helmut Rembold, Stuttgart; Martin Mueller, Möglingen; Christian Preussner, Markgröningen; Andreas Benz, Bamberg; Ottmar Martin, Hochdorf/Eberdingen, all of Germany

[73] Assignee: Robert Bosch GmbH, Stuttgart, Germany

[21] Appl. No.: 09/011,927

[22] PCT Filed: Dec. 17, 1996

[86] PCT No.: PCT/DE96/02397

§ 371 Date: Feb. 17, 1998

§ 102(e) Date: Feb. 17, 1998

[87] PCT Pub. No.: WO97/49911

PCT Pub. Date: Dec. 31, 1997

[30] Foreign Application Priority Data

Jun. 22, 1996 [DE] Germany ..... 196 25 059

[51] Int. Cl.[7] ..... F02M 51/06

[52] U.S. Cl. ..... 239/585.5; 239/463; 239/507; 239/533.12; 239/543; 239/585.1; 239/590.3

[58] Field of Search ..... 239/507, 514, 239/533.7, 533.12, 585.1–585.5, 487, 488, 491–494, 497, 463, 543, 590.3

[56] References Cited

U.S. PATENT DOCUMENTS

| | | | |
|---|---|---|---|
| 4,646,974 | 3/1987 | Sofianek et al. | 239/585.4 X |
| 4,907,745 | 3/1990 | Messingschlager | 239/585.5 X |
| 5,165,656 | 11/1992 | Maier et al. | 239/585.4 X |
| 5,285,970 | 2/1994 | Maier et al. | 239/585.4 X |
| 5,307,997 | 5/1994 | Wakeman . | |
| 5,323,966 | 6/1994 | Buchholz et al. | 239/585.5 X |
| 5,335,864 | 8/1994 | Romann et al. | 239/585.1 |
| 5,350,119 | 9/1994 | Bergstrom . | |
| 5,497,947 | 3/1996 | Potz et al. | 239/533.12 |
| 5,540,387 | 7/1996 | Reiter et al. | 239/585.1 X |

FOREIGN PATENT DOCUMENTS

| | | |
|---|---|---|
| 0042799 | 12/1981 | European Pat. Off. . |
| 0 328 550 B1 | 8/1989 | European Pat. Off. . |
| 19539798 | 5/1996 | Germany . |
| 2087481 | 5/1982 | United Kingdom . |

*Primary Examiner*—Andres Kashnikow
*Assistant Examiner*—Stevens J. Ganey
*Attorney, Agent, or Firm*—Kenyon & Kenyon

[57] ABSTRACT

An injector, in particular for injecting fuel directly into a combustion chamber of an internal combustion engine, having a fuel flow path from a fuel intake to a spray orifice, a plurality of fuel channels being arranged in the flow path in front of the spray orifice, their cross section, given a certain fuel pressure, determining each quantity of fuel spray-discharged per unit of time. To influence the fuel distribution in a spray-discharged fuel cloud and, in particular, to attain a selected strand-like quality of the fuel cloud, provision is made that at least one part of the fuel channels is aligned such that the fuel jets issuing from them are spray-discharged directly through the spray orifice when the valve is open.

30 Claims, 4 Drawing Sheets

Fig. 1
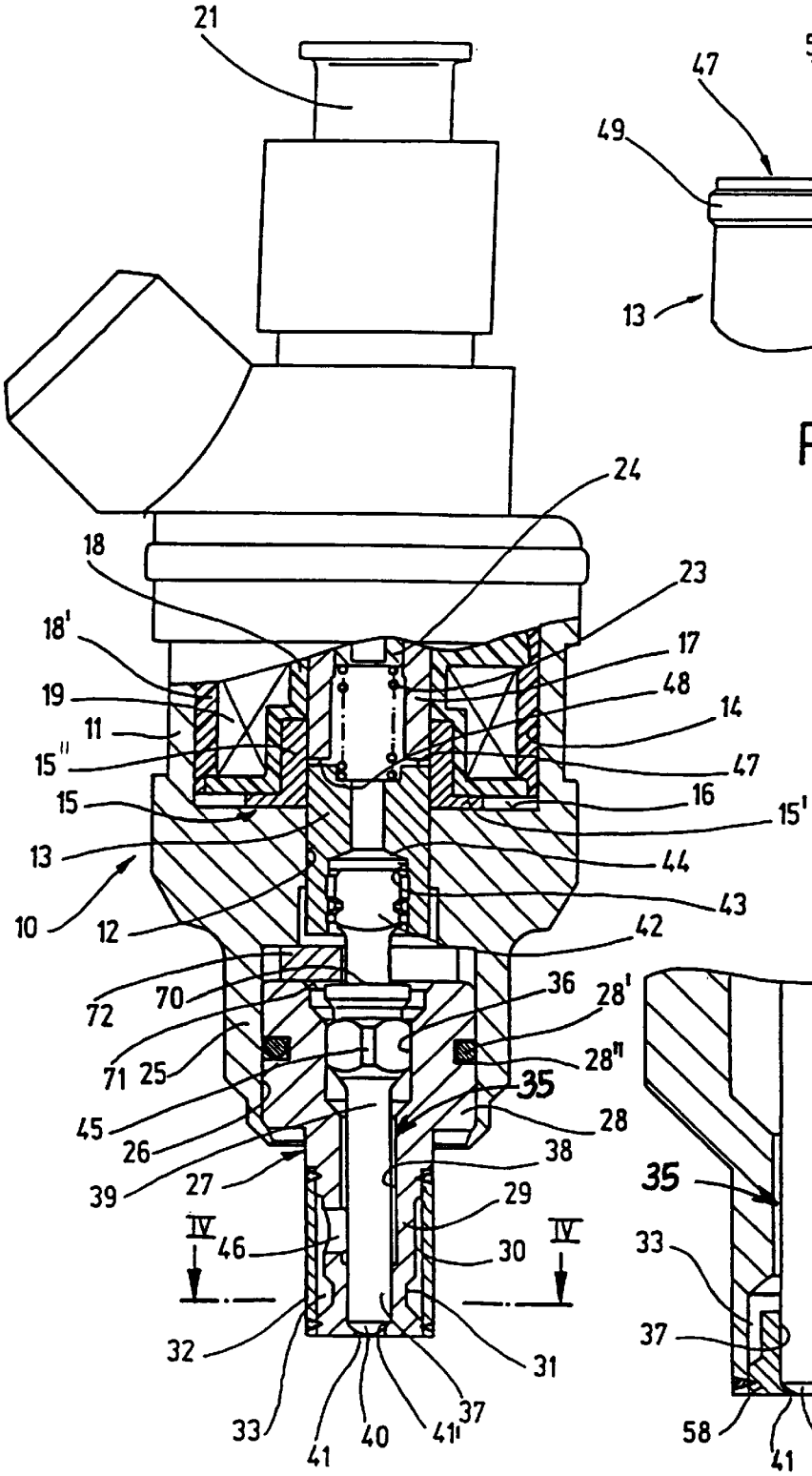
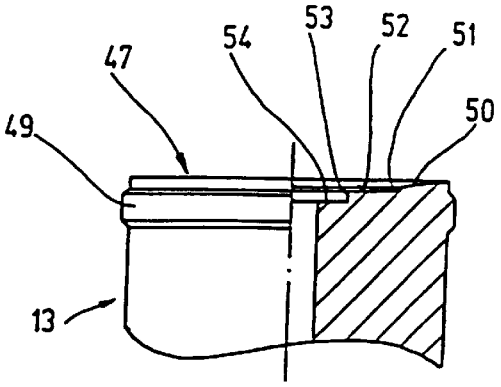
Fig. 2
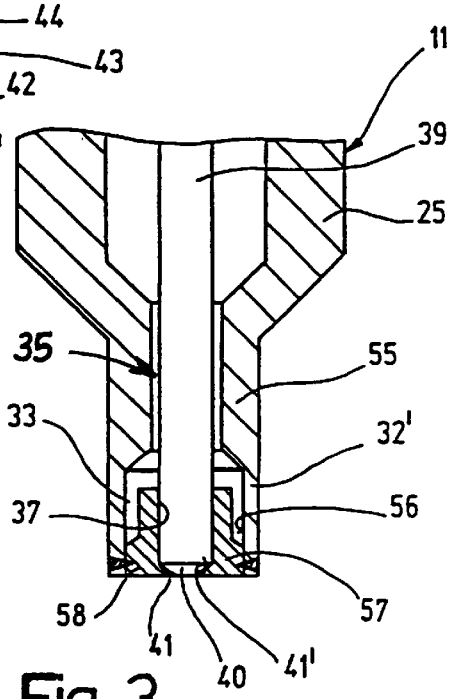
Fig. 3

Fig. 5a
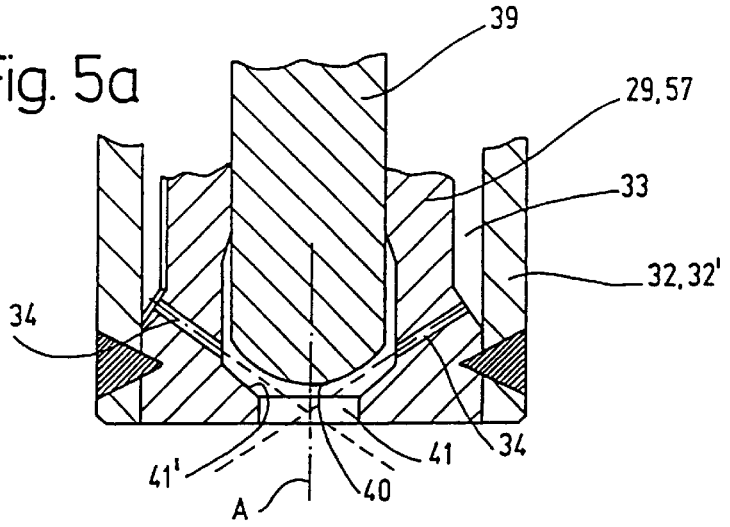
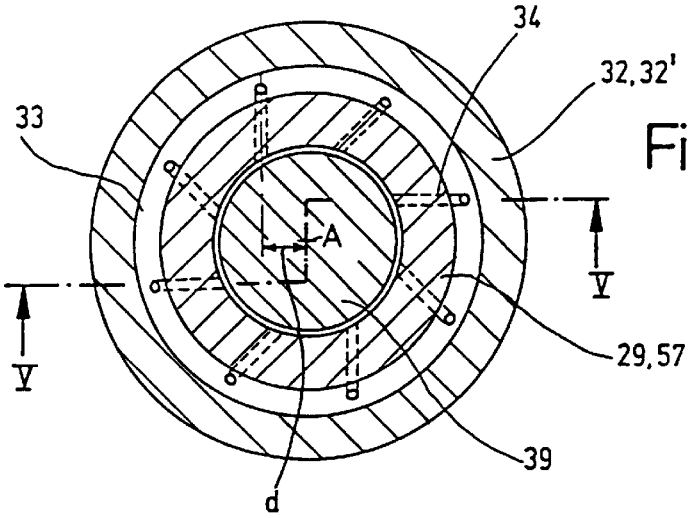
Fig. 4
Fig. 5b
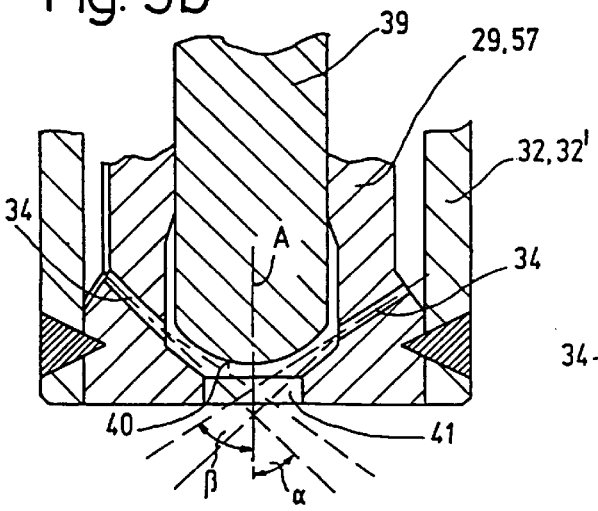
Fig. 5c
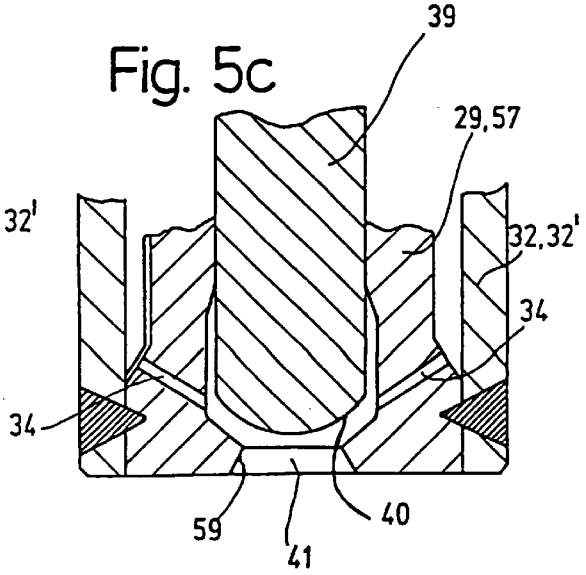

Fig. 7
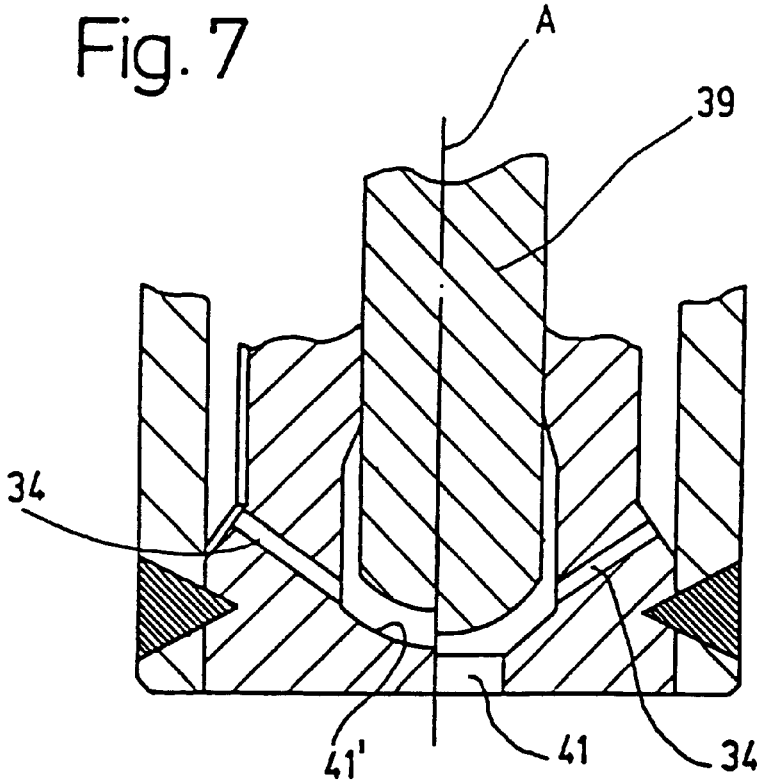
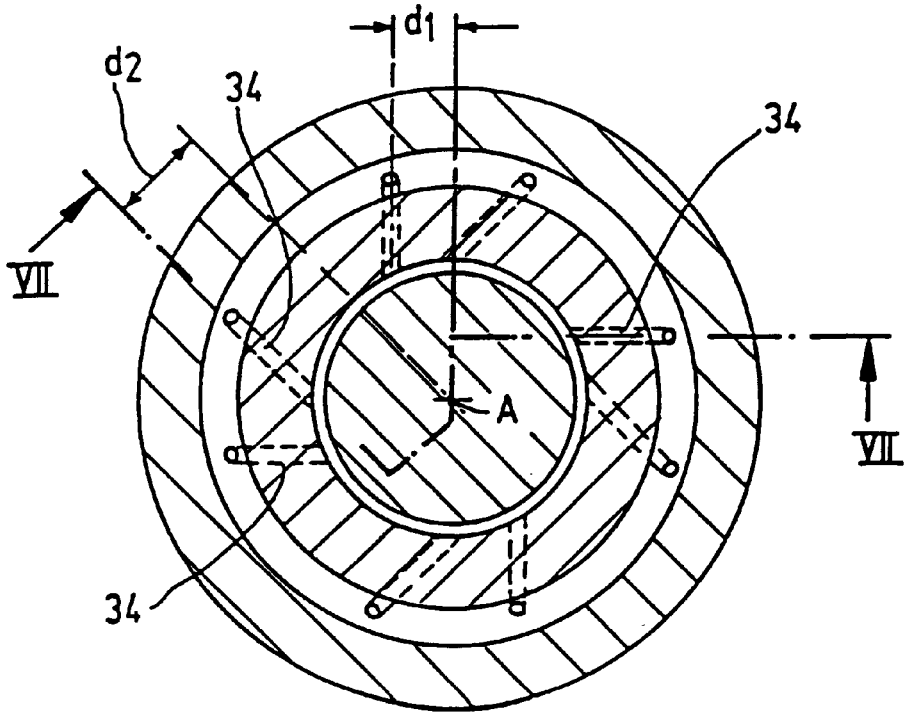
Fig. 6

INJECTION VALVE IN PARTICULAR FOR DIRECTLY INJECTING FUEL INTO THE COMBUSTION CHAMBER OF AN INTERNAL COMBUSTION ENGINE

FIELD OF THE INVENTION

The present invention relates to an injector for injecting fuel directly into a combustion chamber of an internal combustion engine.

BACKGROUND INFORMATION

In a conventional injector (U.S. Pat. No. 5,350,119), provision is made in a valve seat member for an outlet orifice, which is closed by a valve needle, serving as a closing body. Viewed from the flow direction of the fuel, a spray-orifice plate having a spray orifice is arranged behind the outlet orifice, said spray orifice constituting the narrowest flow cross-section in the fuel flow path through the valve and, thus, defining the quantity of spray-discharged fuel, given a certain fuel pressure and duration of opening.

Another conventional injector (European Patent No. 0 328 550) has a pot-shaped valve body, in whose base a guide bore is provided for a valve needle. On the outlet side, provision is made at the base of the valve body for a conical projection extending into a similarly conical cutout in a valve seat member, such that between the valve body and the valve seat member a hollow-cone-shaped swirl or spin chamber is formed, whose tip discharges into a spray orifice, which functions as a metering orifice, and which can be closed by means of the valve needle, guided in the valve body.

In the base of the valve body, distributed around the guide bore, fuel channels are arranged which are tilted and staggered with respect to an axis of rotation of the swirl chamber such that the fuel flowing into the swirl chamber has a speed component in the circumferential direction. In this way, the goal is for the fuel to be spray-discharged, essentially, in the form of a closed hollow cone and to be atomized in the combustion chamber of an internal combustion engine.

In another conventional injector (U.S. Pat. No. 5,307,997), provision is made, in a valve seat member having a spray orifice, for a conical depression into which extends a valve body guiding a valve needle and having a corresponding conical projection. In this way, between the valve body and the valve seat member, a swirl chamber is created, which is located in front of the spray orifice, with respect to the direction of flow.

The fuel is fed into the swirl chamber through fuel channels which are tilted and staggered with respect to an axis of rotation of the swirl chamber, such that the fuel arriving in the swirl chamber has a speed component in the circumferential direction.

The fuel channels comprise a first bore segment, which has a relatively large diameter and relatively great length, and to which is joined, on the outlet side, a bore segment having a reduced diameter and relatively short length. The bore segments having a reduced diameter together constitute the narrowest cross section, necessary for fuel metering, in the flow path through the injector.

Also, in the case of this, conventional injector, the fuel is spray-discharged in the form of a uniform, closed, hollow-cone-shaped fuel lamina.

SUMMARY OF THE INVENTION

In contrast, the injector of the present invention has an advantage in that the spray-discharged fuel cloud has a deliberately strand-like quality, since at least some of the fuel channels are so aligned that the fuel jets spray-discharged from them are sprayed directly through the spray orifice without any further substantial throttling of the fuel flow taking place.

An additional advantage of the injector of the present invention is that the fuel-atomizing elements, in particular, the fuel channels, are separated from the dirty combustion chamber atmosphere when the injector is closed. As a result, there can be no accumulations of dirt depositing themselves on the fuel-atomizing elements and affecting atomization.

By means of an appropriate distribution around the circumference and a corresponding alignment of the fuel channels relative to the center axis of the spray orifice, as well as of a corresponding rotational installation position of the injector relative to a spark plug, which extends into the combustion chamber of an internal combustion engine, a stoichiometric fuel-air mixture is able to be obtained at the spark plug electrodes. In this context, it is expedient to select the alignment of the injector of the present invention relative to the spark plug so that the spark plug is located in a gap between two strand-like fuel jets. It can thus be avoided, with certainty, that the spark plug electrodes are directly sprayed with fuel. In this way, the spark plug electrodes are prevented from cooling off too much, as well as from coking, which is attributable to the former.

The injector of the present invention makes it possible for fuel to be spray-discharged in such a way that, in the combustion chamber of an internal combustion engine, a cohesive fuel-air-mixture cloud, adapted to said combustion chamber, forms with a combustible ratio of fuel and air, without liquid fuel reaching a cylinder wall or a piston crown. In this context, the fuel is able to be so injected into the combustion chamber that, immediately before burning, the fuel is all but completely vaporized.

By means of the varying slopes of the fuel channels relative to the center axis of the spray orifice, fuel may be spray-discharged into the combustion chamber so as to fill up the space. By appropriately selecting the inclinations of the fuel channels with respect to the center axis of the spray orifice, which corresponds to the main axis of the injector, a fuel cloud can be obtained, whose main axis is inclined with respect to the center axis of the spray orifice. Thus, with the injector of the present invention, the fuel cloud can be spray-discharged obliquely, i.e., into the combustion chamber, which can be necessary particularly considering the lack of design space in the cylinder head of the internal combustion engine, in order to ensure an injection of fuel that fills the combustion chamber, for example, in the case of a lateral positioning of the injector.

To improve the fuel vaporization, it is also possible to allow one part of the fuel jets issuing from the fuel channels to impact against a surface surrounding the spray orifice, and functioning as a valve seat, or one adjacent to it, against the wall of the spray orifice, or against the valve needle, in order to achieve a deflection, a fanning out, and/or an impact vaporization of the fuel. In this way, a fuel-air-mixture cloud can be produced which is formed with one portion of the fuel in the form of a hollow cone, such as is generated with a swirl nozzle, as well as with another part of the fuel in the form of strand-like jets, such as is effected by a multi-hole nozzle.

It is also possible to improve fuel atomization and selectively influence the fuel distribution in the combustion chamber by having individual fuel jets collide with one another.

To prevent fuel deposits from accumulating on the wall surrounding the spray orifice, it is particularly effective for the spray orifice to be surrounded by a cone-shaped wall that widens in the spray-discharge direction.

BRIEF DESCRIPTION OF THE DRAWINGS

FIG. 1 illustrates a schematic view, in partial cross section, of an injector according to an embodiment of the present invention.

FIG. 2 illustrates a schematic view, in partial cross section, of an armature of an electromagnetic actuating device for the injector of the present invention.

FIG. 3 illustrates a schematic cross section of the outlet area of an injector according to an embodiment of the present invention.

FIG. 4 illustrates a cross section essentially along line IV—IV in FIG. 1.

FIG. 5*a* illustrates a cross section essentially along line V—V in FIG. 4.

FIG. 5*b* illustrates a cross section essentially along line V—V in FIG. 4.

FIG. 5*c* illustrates a cross section essentially along line V—V in FIG. 4.

FIG. 6 illustrates a cross section essentially along line IV—IV in FIG. 1.

FIG. 7 illustrates a cross section essentially along line VII—VII in FIG. 6.

DETAILED DESCRIPTION

Figure 8:
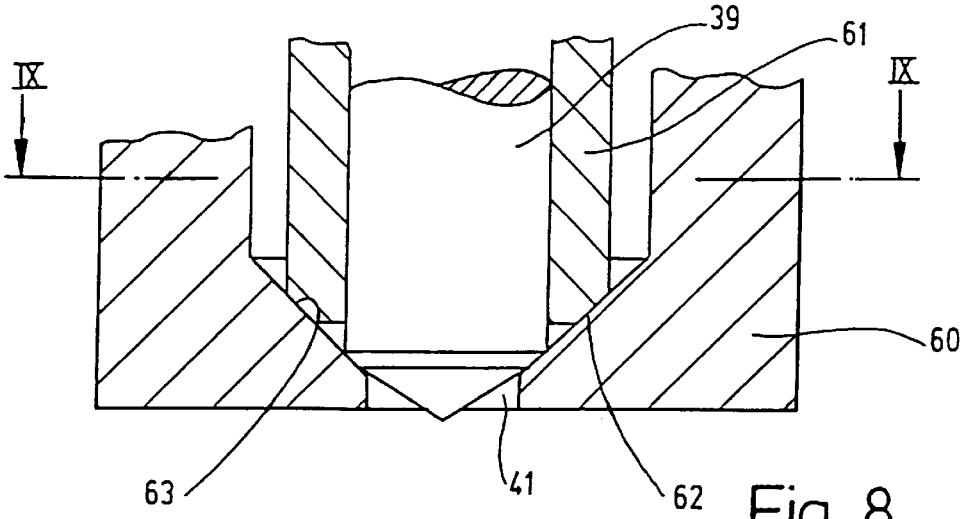
FIG. 8 illustrates a schematic cross section of an outlet area of a valve body for an injector according to an embodiment of the present invention.

In the various Figures of the drawing, corresponding components are designated with the same reference numerals.

As FIG. 1 shows, the injector of the present invention has a housing 10 with a housing body 11, in which provision is made for a central guide bore 12 for an armature 13 of an electromagnetic actuating device. A coil holding segment 14 having an expanded diameter joins up with guide bore 12 toward the fuel supply side, i.e., toward the top of FIG. 1.

A non-magnetic intermediate ring 15 having a radial flange 15' and a sleeve segment 15" rests with its flange 15' on a radial stepped surface 16 and is securely joined, e.g., by soldering, to housing body 11. A connecting pipe 17 is inserted into sleeve segment 15" of intermediate ring 15 and is joined thereto, e.g., by soldering. Coil holding segment 14 is thus bounded radially to the inside by intermediate ring 15 and connecting pipe 17.

A solenoid coil 19, accommodated in a coil holder 18, is mounted in coil holding segment 14, radially bounded to the inside, said coil being encapsulated by a plastic shell 18' in coil holder 18. Fuel flowing through the injector thus can not penetrate into coil holding segment 14 because of intermediate ring 15, disposed between connecting pipe 17 and housing body 11, so that solenoid coil 19 is kept dry in the injector.

A connecting piece 21 for a fuel intake line is joined to connecting pipe 17 in a manner which is not further described.

A closing spring 23 is arranged in connecting pipe 17 and is held between armature 13 and a supporting sleeve 24 which is immovably or adjustably mounted in connecting pipe 17.

A valve body 27 having a piston-like widened end 28 is set into a receiving bore 26 provided in an outlet-side receiving segment 25 of housing body 11, said valve body 29 being provided with a sealing ring 28' in a groove 28". On its outer circumference, an outlet-side pipe segment 29 of valve body 27 has, running around the circumference, a recess 30, which changes into a peripheral groove 31 near the outlet-side end of pipe segment 28. A sleeve 32, which is welded to pipe segment 29 of valve body 27 in front of recess 30 and behind peripheral groove 31, is slipped over recess 30 and peripheral groove 31, forming a fuel supply area 33 for fuel channels 34 (FIG. 4, FIGS. 5*a* to 5*c*).

Valve body 27 has a stepped through-hole 35, comprising a first guide segment 36 provided in the piston-like widened end 28, comprising a second guide segment 37 provided in the area of the outlet-side end of pipe segment 29, and comprising a fuel passage area 38 located between the two guide segments. In through-hole 35 of valve body 27, a valve needle 39, which is used as the closing body of the injector, is guided, having on its outlet-side end a sealing surface 40 which cooperates with a valve seat 41' surrounding a spray orifice 41. The end of valve needle 39 facing away from sealing surface 40 is secured to a fastening segment 42 in a widened segment 43 of a through-hole 44 in armature 13.

To create a fuel flow path from connecting piece 21 through supporting sleeve 24, connecting pipe 17, and armature 13, to fuel passage area 38, fastening segment 42 and a segment 45 of valve needle 39, guided in guide segment 36, are provided with flattened areas or recesses. The supply of fuel from fuel passage area 38 to fuel supply area 33 of fuel channels 34 is made possible by means of a transverse bore 46.

To open the injector, solenoid coil 19 is charged with current or excited and, in the process, pulls up armature 13, together with valve needle 39, against the force of closing spring 23 until armature 13 strikes with an end face 47 against an end face 48 of connecting pipe 17, functioning as a limit stop, or until valve needle 39 strikes with a surface 70 against an end face 71 of a supporting disk 72, functioning as a limit stop. As soon as the current supply to solenoid coil 19 is interrupted, closing spring 23, via armature 13, presses valve needle 39 once again into its closed position, in which sealing surface 40 abuts against valve seat 41' and seals off spray orifice 41.

When armature 13 performs the stroke limiting function, as shown by FIG. 2, it is beneficial for said armature 13 to be provided at its end with a guide collar 49, located in the area of non-magnetic intermediate ring 15, so that armature 13 is guided in non-magnetic intermediate ring 15. End face 47 of armature 13, facing connecting pipe 17 surrounds a stop face 50, situated radially to the outside, to which is joined, to the inside via a step 51, a set-back ring surface 52, which is separated by a further step 53 from a supporting surface 54 for closing spring 23. Stop face 50, in this context, has a width in the radial direction of about 1 to 2 mm and is wedge-shaped, i.e., cone-shaped, the inside edge of stop face 50 being set back from the outer edge. The height of step 53 between stop face 50 and set-back ring surface 52 is approximately 50 $\mu$m. To increase the resistance to wear, armature 13 is chrome-plated, at least in the area of its end face, which functions as a stop face 47, and optionally, of its guide collar 49.

As FIG. 3 shows, in another embodiment of the present invention, mounting segment 25 of housing body 11 has a pipe socket 55 on the outlet side, in whose outlet-side end provision is made for a receiving bore 56 for a sleeve-shaped valve body 57. Valve body 57 has a through-hole with a guide segment 37 for a valve needle 39, said guide segment 37 discharging into a spray orifice 41, which is surrounded by a valve seat 41'.

Provision is made at the end of valve seat 57 assigned to spray orifice 41 for a fastening flange 58, which is sealingly connected, e.g., welded or soldered, to a sleeve segment 32' of pipe socket 55, which surrounds receiving bore 56 and is comparable in its action to sleeve 32 in the exemplary embodiment according to FIG. 1. On the side of fastening flange 58 turned away from the outlet-side end face of valve body 57, provision is made for a fuel supply area 33, between valve body 57 and sleeve segment 32' of pipe socket 55, for fuel channels 34 drilled in valve body 57 (FIG. 4, FIGS. 5*a*, 5*b*).

As FIGS. 4 and 5*a* show, provision is made in valve body 29 or 57 for fuel channels 34, which are designed as bore holes and connect fuel supply area 33 with the area of spray orifice 41. In this context, as shown in 5*a*, fuel channels 34 are inclined with respect to center axis A of discharge outlet 41 and are offset from center axis A, as in FIG. 4, such that they lead past center axis A at a distance d.

If the injector, as shown in FIG. 5*a*, is opened, the fuel jets issuing from fuel channels 34 are spray-discharged through spray orifice 41 directly into the spray-discharge area located in front of the injector, in particular, into the combustion chamber of an internal combustion engine. In this context, the individual fuel jets run past each other so that the fuel cloud formed in the injection area has a strand-like quality corresponding to the fuel jets.

Depending on the strand-like quality desired for the fuel cloud, individual fuel channels 34 can be evenly spaced apart in the circumferential direction. However, they can also be spaced apart with different circumferential distances intervals. In particular, in the case of fixed rotational installation position of the injector, a gap between two fuel channels 34 across from a spark plug may be made larger or smaller than the other distances between fuel channels 34, to ensure a stoichiometric fuel-air mixture in the area of the spark plug.

The individual fuel channels 34 together constitute the narrowest flow cross-section for the passage of the fuel through the injector. Therefore, the total flow cross-sections of individual fuel channels 34, together with both the injector's duration of opening and the fuel pressure, determine the quantity of fuel spray-discharged at any given moment.

In this context, the flow cross-sections between sealing surface 40 and valve seat 41', as well as the flow cross-section of spray orifice 41, are considerably greater than the total cross-section of fuel channels 34. However, it is also possible to make the flow cross-section behind fuel channels 34 narrow enough to produce a partial throttling of the fuel flow between sealing surface 40 and valve seat 41', or in spray orifice 41.

In another embodiment of the present invention, individual fuel channels 34 are, in fact, offset relative to central axis A of spray orifice 41 in the same way, but they are tilted at various angles of inclination $\alpha$, $\beta$ relative to central axis A of spray orifice 41, as is shown in FIG. 5*b*. By varying the inclinations of fuel channels 34 relative to central axis A, a spray-discharged fuel cloud may be attained that has a first part with a relatively large diameter already in the vicinity of the spray orifice, whereas a second part of the fuel cloud penetrates deeper into the spray-discharge area, thus, into the combustion chamber, thus assuring an even fuel distribution. To create a stoichiometric fuel-air mixture in the area of a spark plug, it is also possible in this context for fuel channels 34, through which the fuel is spray-discharged in the vicinity of a spark plug, to be configured at a corresponding angle of inclination relative to the central axis of the spray orifice 41.

In particular, when large angles of inclination $\alpha$, $\beta$ are required for fuel channels 34, it is beneficial, as is shown in FIG. 5*c*, for spray orifice 41 to be surrounded by a hollow-cone-shaped wall 59.

According to another embodiment of the present invention, fuel channels 34 are, in fact, inclined in the same manner relative to central axis A of spray orifice 41, but they are variably offset thereto. Fuel channel 34 depicted in FIG. 7 on the right side has a distance $d_1$ from axis A, while fuel channel 34 A depicted on the left side is arranged at an increased distance $d_2$ from the axis of spray orifice 41, so that the fuel spray-discharged through this fuel channel 34 in the area of spray orifice 41 strikes against the surface of valve seat 41' and is atomized there.

Individual fuel channels 34 can be also arranged such that the corresponding fuel jets strike against the wall surrounding spray orifice 41 or against the tip of valve needle 39.

Moreover, provision can be made for the fuel jets created by means of fuel channels 34 to collide with one another, thus improving the fuel atomization, in particular for the spray-discharge area located relatively near to the injector.

Figure 10:
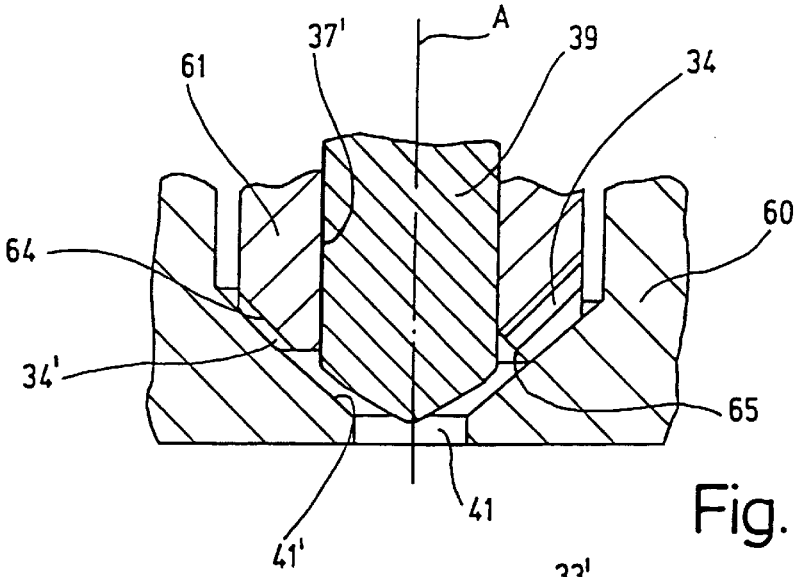
FIG. 10 illustrates a cross section essentially along line X—X in FIG. 9.
Figure 9:
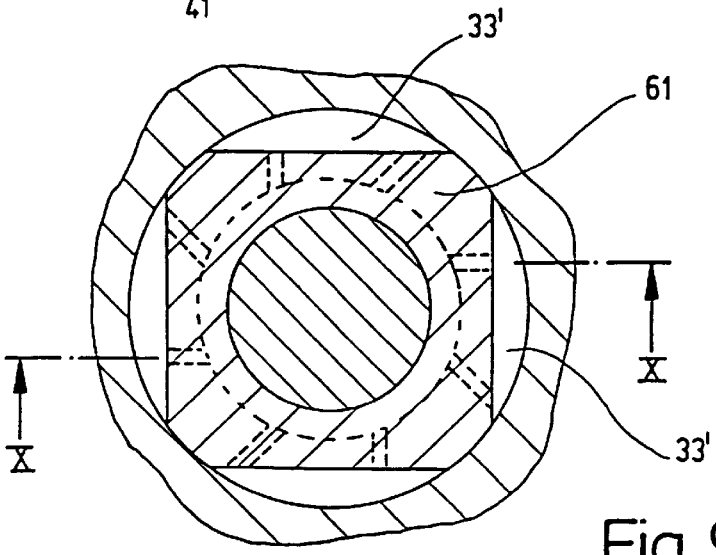
FIG. 9 illustrates a cross section essentially along line IX—IX in FIG. 8.

In another embodiment of the present invention, as seen in FIGS. 8 through 10, provision is made for a pot-shaped valve body 60, into which is inserted a sleeve-shaped guide insert 61 having a guide bore 37' for valve needle 39. As FIG. 9 shows, guide insert 61 has a roughly rectangular external cross-section with a rounded-off edge corresponding to the inner diameter of valve body 60, permitting it to be inserted into valve body 60. End face 62 of guide insert 61, facing spray orifice 41, is tapered to a cone shape and lies on a similarly cone-shaped bottom surface 63 of valve body 60.

As illustrated in FIG. 10, left, in cone-shaped end face 62 of guide socket 61, provision is made for grooves 64 which form fuel channels 34'. However, it is also possible to design fuel channels 34 as bore holes, as shown on the right side of FIG. 10.

In this regard, it is beneficial for guide insert 61, at its end facing spray orifice 41, has to have a recess 65 surrounding guide bore 37'.

Also in the case of this embodiment of the present invention, individual fuel channels 34, 34' may be arranged at various inclinations and intervals relative to central axis A of spray orifice 41. If, given the same inclination, all that is required for individual fuel channels 34, 34' is different intervals to central axis A of spray orifice 41, then all fuel channels 34' can be created by such grooves 64. If, on the other hand, different inclinations are also desired, then it is possible for some of fuel channels 34' to be formed as is grooves by means of slots, while other fuel channels 34, having different inclinations, are designed as bore holes. In this regard, it is expedient to configure fuel channels 34' with a greater inclination relative to central axis A of spray orifice 41 than fuel channels 34 made with bore holes.

Using a pot-shaped valve body 60, where fuel supply areas 33' for individual fuel channels 34, 34' are formed within the valve body, has the advantage that valve body 60 can be sealed off from the valve housing at a relatively large distance from the spray-discharge-side end face of valve body 60.

Fuel channels 34, 34', in a manner that is not further described here, can also have different flow cross-sections in order to attain the desired fuel distribution. In this context, fuel channels 34, 34' can alternate with small and large cross sections. It is likewise possible for only one or two fuel channels 34, 34' to have an enlarged or reduced flow cross-section.

What is claimed is:

1. An injector for spraying fuel directly into a combustion chamber of an internal combustion engine, comprising:

a fuel intake;

a fuel flow path connecting the fuel intake to a spray orifice as a fuel outlet;

a valve seat;

a valve closing body interacting with the valve seat; and a plurality of fuel channels in the fuel flow path upstream of the valve seat in front of the spray orifice, wherein a cross section of the plurality of fuel channels determines, at a predetermined fuel pressure, a quantity of fuel spray-discharged in a predetermined unit of time, wherein at least one part of the plurality of fuel channels is aligned such that, when a valve is open, fuel jets issuing from the at least one part of the plurality of fuel channels are spray-discharged directly through the spray orifice, and wherein at least two fuel channels of the plurality of fuel channels are inclined relative to a central axis of the spray orifice.

2. The injector according to claim 1, wherein the fuel jets issuing from the plurality of fuel channels are inclined and offset with respect to a central axis, the central axis lying at a right angle to a plane of the spray orifice.

3. The injector according to claim 1, further comprising at least two groups of the plurality of fuel channels, wherein the plurality of fuel channels of one of the at least two groups are inclined and offset each in a same manner relative to a central axis of the spray orifice.

4. An iniector for spraying fuel directly into a combustion chamber of an internal combustion engine, comprising:

a fuel intake;

a fuel flow path connecting the fuel intake to a spray orifice;

a plurality of fuel channels in the fuel flow path in front of the spray orifice, wherein a cross section of the plurality of fuel channels determines, at a predetermined fuel pressure, a quantity of fuel spray-discharged in a predetermined unit of time, wherein at least one part of the plurality of fuel channels is aligned such that, when a valve is open, fuel jets issuing from the at least one part of the plurality of fuel channels are spray-discharged directly through the spray orifice; and at least two groups of the plurality of fuel channels, wherein the plurality of fuel channels of one of the at least two groups are inclined and offset each in a same manner relative to a central axis of the spray orifice, wherein all of the plurality of fuel channels have a same inclination with respect to the central axis of the spray orifice and wherein the plurality of fuel channels belonging to different ones of the at least two groups are offset at different distances relative to the central axis of the spray orifice.

5. The injector according to claim 4, wherein the plurality of fuel channels, in relation to the spray orifice, are at various distances from each other in a circumferential direction.

6. The injector according to claim 4, wherein the plurality of fuel channels includes another part, the another part of the plurality of fuel channels is aligned such that the fuel jets issuing from the another part of the plurality of fuel channels strike, at an acute angle, against a surface in front of the spray orifice, the surface surrounding the spray orifice.

7. The injector according to claim 4, wherein the valve includes a closing body and wherein the plurality of fuel channels includes another part, the fuel jets issuing from the another part of the plurality of fuel channels and striking against an impact area on the closing body, the closing body closing the spray orifice when the valve is closed.

8. The injector according to claim 4, wherein the plurality of fuel channels includes another part, the fuel jets issuing from the another part of the plurality of fuel channels and striking against a wall surrounding the spray orifice.

9. The injector according to claim 4, wherein the at least one part of the plurality of fuel channels is surrounding and offset relative to a central axis of the spray orifice such that the fuel jets issuing from the plurality of fuel channels are spray-discharged into the combustion chamber, the fuel jets passing by each other.

10. The injector according to claim 4, wherein the at least one part of the plurality of fuel channels is inclined and offset relative to a central axis of the spray orifice such that the fuel jets issuing from the plurality of fuel channels collide with one another, wherein colliding fuel jets preferably strike one another behind the spray orifice.

11. The injector according to claim 4, wherein the plurality of fuel channels are aligned such that a central axis of one fuel cloud formed by the plurality of fuel channels is inclined with respect to a central axis of the spray orifice.

12. The injector according to claim 4, further comprising a cone-shaped wall surrounding the spray orifice, the cone-shaped wall diverging in a direction of a fuel spray.

13. The injector according to claim 4, wherein the plurality of fuel channels are disposed in a valve body, the valve including a closing body, the valve body guiding the closing body which closes the spray orifice when the valve is closed.

14. The injector according to claim 4, further comprising:

a pot-shaped valve body;

a guide insert inside the pot-shaped valve body; and the valve including a closing body, the closing body being inserted into the guide insert, the closing body closing the spray orifice when the valve is closed, wherein an outer circumferential surface of the closing body provides for at least one fuel supply area between a circumferential wall of the pot-shaped valve body and the guide insert, the at least one fuel supply being connected to the plurality of fuel channels configured on the guide insert.

15. The injector according to claim 14, wherein an end face of the guide insert includes a plurality of grooves, the plurality of grooves forming the plurality of fuel channels and the end face coupled with the pot-shaped valve body.

16. The injector according to claim 14, wherein the at least one part of the plurality of fuel channels has bore holes in the guide insert.

17. An injector for spraying fuel directly into a combustion chamber of an internal combustion engine, comprising:

a fuel intake;

a fuel flow path connecting the fuel intake to a spray orifice;

a plurality of fuel channels in the fuel flow path in front of the spray orifice, wherein a cross section of the plurality of fuel channels determines, at a predetermined fuel pressure, a quantity of fuel spray-discharged in a predetermined unit of time, wherein at least one part of the plurality of fuel channels is aligned such that, when a valve is open, fuel jets issuing from the at least one part of the plurality of fuel channels are spray-discharged directly through the spray orifice; and at least two groups of the plurality of fuel channels, wherein the plurality of fuel channels of one of the at least two groups are inclined and offset each in a same manner relative to a central axis of the spray orifice, wherein all of the plurality of fuel channels are offset in a same manner relative to the central axis of the spray orifice and wherein the plurality of fuel channels belonging to different ones of the at least two groups are variably inclined relative to the central axis of the spray orifice.

18. The injector according to claim 17, wherein the plurality of fuel channels, in relation to the spray orifice, are at various distances from each other in a circumferential direction.

19. The injector according to claim 17, wherein the plurality of fuel channels includes another part, the another part of the plurality of fuel channels is aligned such that the fuel jets issuing from the another part of the plurality of fuel channels strike, at an acute angle, against a surface in front of the spray orifice, the surface surrounding the spray orifice.

20. The injector according to claim 17, wherein the valve includes a closing body and wherein the plurality of fuel channels includes another part, the fuel jets issuing from the another part of the plurality of fuel channels and striking against an impact area on the closing body, the closing body closing the spray orifice when the valve is closed.

21. The injector according to claim 17, wherein the plurality of fuel channels includes another part, the fuel jets issuing from the another part of the plurality of fuel channels and striking against a wall surrounding the spray orifice.

22. The injector according to claim 17, wherein the at least one part of the plurality of fuel channels is surrounding and offset relative to a central axis of the spray orifice such that the fuel jets issuing from the plurality of fuel channels are spray-discharged into the combustion chamber, the fuel jets passing by each other.

23. The injector according to claim 17, wherein the at least one part of the plurality of fuel channels is inclined and offset relative to a central axis of the spray orifice such that the fuel jets issuing from the plurality of fuel channels collide with one another, wherein colliding fuel jets preferably strike one another behind the spray orifice.

24. The injector according to claim 17, wherein the plurality of fuel channels are aligned such that a central axis of one fuel cloud formed by the plurality of fuel channels is inclined with respect to a central axis of the spray orifice.

25. The injector according to claim 17, further comprising a cone-shaped wall surrounding the spray orifice, the cone-shaped wall diverging in a direction of a fuel spray.

26. The injector according to claim 17, wherein the plurality of fuel channels are disposed in a valve body, the valve including a closing body, the valve body guiding the closing body which closes the spray orifice when the valve is closed.

27. The injector according to claim 17, further comprising:

a pot-shaped valve body;

a guide insert inside the pot-shaped valve body; and the valve including a closing body, the closing body being inserted into the guide insert, the closing body closing the spray orifice when the valve is closed, wherein an outer circumferential surface of the closing body provides for at least one fuel supply area between a circumferential wall of the pot-shaped valve body and the guide insert, the at least one fuel supply being connected to the plurality of fuel channels configured on the guide insert.

28. The injector according to claim 27, wherein an end face of the guide insert includes a plurality of grooves, the plurality of grooves forming the plurality of fuel channels and the end face coupled with the pot-shaped valve body.

29. The injector according to claim 27, wherein the at least one part of the plurality of fuel channels has bore holes in the guide insert.

30. An injector for spraying fuel directly into a combustion chamber of an internal combustion engine, comprising:

a fuel intake;

a fuel flow path connecting the fuel intake to a spray orifice as a fuel outlet;

a valve seat;

a valve closing body interacting with the valve seat; and a plurality of fuel channels in the fuel flow path upstream of the valve seat in front of the spray orifice, wherein a cross section of the plurality of fuel channels determines, at a predetermined fuel pressure, a quantity of fuel spray-discharged in a predetermined unit of time, wherein at least one part of the plurality of fuel channels is aligned such that, when a valve is open, fuel jets issuing from the at least one part of the plurality of fuel channels are spray-discharged directly through the spray orifice, and wherein at least two fuel channels of the plurality of fuel channels are offset different distances relative to a central axis of the spray orifice.

* * * * *